US009324472B2

(12) United States Patent
Lee

(10) Patent No.: US 9,324,472 B2
(45) Date of Patent: Apr. 26, 2016

(54) METAL AND METALLIZED FIBER HYBRID WIRE

(75) Inventor: Jar-Wha Lee, Columbus, OH (US)

(73) Assignee: Syscom Advanced Materials, Inc., Columbus, OH (US)

( * ) Notice: Subject to any disclaimer, the term of this patent is extended or adjusted under 35 U.S.C. 154(b) by 15 days.

(21) Appl. No.: 13/340,355

(22) Filed: Dec. 29, 2011

(65) Prior Publication Data

US 2012/0171485 A1 Jul. 5, 2012

Related U.S. Application Data

(60) Provisional application No. 61/428,175, filed on Dec. 29, 2010.

(51) Int. Cl.

| | |
|---|---|
| ***H01B 1/02*** | (2006.01) |
| ***D06M 11/83*** | (2006.01) |
| ***H01B 1/22*** | (2006.01) |

(52) U.S. Cl.

CPC ..... *H01B 1/026* (2013.01); *D06M 11/83* (2013.01); *H01B 1/22* (2013.01); *Y10T 428/2929* (2015.01)

(58) Field of Classification Search

USPC ..... 428/373, 377, 379; 174/108, 68.1

See application file for complete search history.

(56) References Cited

U.S. PATENT DOCUMENTS

| | | | | |
|---|---|---|---|---|
| 3,247,082 A | | 4/1966 | Du Rose | |
| 3,308,042 A | | 3/1967 | Lozano et al. | |
| 3,460,978 A | | 8/1969 | McGovney et al. | |
| 3,615,281 A | | 10/1971 | Ramsden | |
| 3,661,728 A | | 5/1972 | Toledo | |
| 3,674,550 A | | 7/1972 | Mallory | |
| 3,681,514 A | * | 8/1972 | Rhoades et al. | 174/108 |
| 3,708,405 A | | 1/1973 | Kamata | |
| 3,870,551 A | | 3/1975 | Iwami et al. | |
| 3,874,030 A | | 4/1975 | Knight et al. | |
| 3,896,010 A | | 7/1975 | Vetter et al. | |
| 3,910,069 A | | 10/1975 | Ricart et al. | |
| 3,915,667 A | | 10/1975 | Ricks | |
| 3,919,069 A | | 11/1975 | Ascher et al. | |
| 3,962,494 A | | 6/1976 | Nuzzi | |
| 3,967,010 A | | 6/1976 | Maekawa | |
| 4,008,343 A | | 2/1977 | Cohen | |

(Continued)

FOREIGN PATENT DOCUMENTS

| | | |
|---|---|---|
| CA | 2053798 A1 | 10/1992 |
| CN | 101950604 A | 1/2011 |

(Continued)

OTHER PUBLICATIONS

USPTO Non Final Rejection mailed Oct. 20, 2014 in reference to co-pending U.S. Appl. No. 13/187,927, filed Jul. 21, 2011.

(Continued)

*Primary Examiner* — Lynda Salvatore
(74) *Attorney, Agent, or Firm* — Dinsmore & Shohl LLP

(57) ABSTRACT

Conductive metal and metallized fiber hybrid wires are disclosed, wherein such wires have a central member and a peripheral member and comprise at least one conductive metallized fiber. The peripheral member comprises (i) at least one conductive metal filament; and (ii) optionally, at least one conductive metallized fiber. The central member comprises (i) at least one non-metallized fiber; (ii) at least one conductive metallized fiber; (iii) at least one conductive metal filament; or (iv) combinations thereof.

20 Claims, 4 Drawing Sheets

(56) References Cited

U.S. PATENT DOCUMENTS

| | | | | |
|---|---|---|---|---|
| 4,086,374 | A | 4/1978 | Suzuki et al. | |
| 4,128,459 | A | 12/1978 | Bretts et al. | |
| 4,161,470 | A | 7/1979 | Calundann | |
| 4,169,426 | A | 10/1979 | Kornmann et al. | |
| 4,214,961 | A | 7/1980 | Anthony | |
| 4,388,370 | A | 6/1983 | Ellis et al. | |
| 4,395,320 | A | 7/1983 | Kasashima et al. | |
| 4,400,974 | A * | 8/1983 | Nishimura et al. | 73/114.34 |
| 4,440,974 | A * | 4/1984 | Naudet | 174/108 |
| 4,456,508 | A | 6/1984 | Torday et al. | |
| 4,511,438 | A | 4/1985 | DiStefano et al. | |
| 4,609,437 | A | 9/1986 | Kruishoop et al. | |
| 4,624,751 | A | 11/1986 | Morin et al. | |
| 4,634,805 | A | 1/1987 | Orban | |
| 4,784,899 | A | 11/1988 | Ono et al. | |
| 4,911,797 | A | 3/1990 | Hoebel et al. | |
| 4,954,479 | A | 9/1990 | Dubots et al. | |
| 4,959,129 | A | 9/1990 | Fuchs et al. | |
| 5,021,258 | A | 6/1991 | McGarry | |
| 5,100,517 | A | 3/1992 | Starinshak et al. | |
| 5,103,067 | A | 4/1992 | Aldissi | |
| 5,230,927 | A | 7/1993 | Nishizawa et al. | |
| 5,244,748 | A | 9/1993 | Weeks, Jr. et al. | |
| 5,302,415 | A | 4/1994 | Gabara et al. | |
| 5,399,382 | A | 3/1995 | Burch et al. | |
| 5,399,425 | A | 3/1995 | Burch | |
| 5,422,142 | A | 6/1995 | Hsu | |
| 5,453,299 | A | 9/1995 | Hsu | |
| 5,528,105 | A | 6/1996 | Brinn et al. | |
| 5,528,799 | A | 6/1996 | Bach et al. | |
| 5,688,594 | A | 11/1997 | Lichscheidt et al. | |
| 5,792,713 | A | 8/1998 | Scari et al. | |
| 5,827,997 | A | 10/1998 | Chung et al. | |
| 5,873,961 | A | 2/1999 | Bhagwat et al. | |
| 5,935,706 | A | 8/1999 | Hoover et al. | |
| 5,976,704 | A * | 11/1999 | McCune | 428/469 |
| 6,045,680 | A | 4/2000 | Cawston et al. | |
| 6,054,647 | A | 4/2000 | Ridener | |
| 6,099,624 | A | 8/2000 | Martyak | |
| 6,112,395 | A * | 9/2000 | Quick et al. | 29/419.1 |
| 6,187,378 | B1 | 2/2001 | Doncsecz | |
| 6,199,266 | B1 | 3/2001 | Meserve | |
| 6,228,922 | B1 | 5/2001 | Wang et al. | |
| 6,281,157 | B1 | 8/2001 | Tangi et al. | |
| 6,316,122 | B1 | 11/2001 | Amamoto | |
| 6,726,964 | B1 | 4/2004 | Thompson et al. | |
| 7,105,740 | B2 | 9/2006 | Allaire et al. | |
| 7,166,354 | B2 | 1/2007 | Tsunashima et al. | |
| 7,291,391 | B2 | 11/2007 | Watson et al. | |
| 7,923,390 | B2 | 4/2011 | Burke | |
| 8,137,752 | B2 | 3/2012 | Lee | |
| 2003/0129900 | A1 | 7/2003 | Chiou | |
| 2003/0224111 | A1 | 12/2003 | Suganuma et al. | |
| 2005/0089639 | A1 | 4/2005 | Suganuma et al. | |
| 2005/0123681 | A1 | 6/2005 | Lee | |
| 2006/0057415 | A1 | 3/2006 | Watson et al. | |
| 2007/0031621 | A1 | 2/2007 | Morimoto et al. | |
| 2007/0059524 | A1 | 3/2007 | Voigt | |
| 2007/0089899 | A1 | 4/2007 | Roberts et al. | |
| 2007/0131164 | A1 | 6/2007 | Park et al. | |
| 2008/0280045 | A1 | 11/2008 | Lee | |
| 2009/0075089 | A1 | 3/2009 | Ohta et al. | |
| 2009/0305897 | A1 * | 12/2009 | Grasso et al. | 505/232 |
| 2011/0005808 | A1 | 1/2011 | White et al. | |
| 2012/0021218 | A1 * | 1/2012 | Lee et al. | 428/395 |
| 2012/0037140 | A1 | 2/2012 | Campos et al. | |

FOREIGN PATENT DOCUMENTS

| | | | |
|---|---|---|---|
| CN | 201829207 | U | 5/2011 |
| EP | 0054402 | A2 | 6/1982 |
| EP | 508212 | A1 | 10/1995 |
| EP | 485991 | B1 | 1/1997 |
| EP | 829547 | A2 | 11/2001 |
| EP | 1089299 | A2 | 12/2005 |
| GB | 524569 | A | 8/1940 |
| JP | 53007570 | A | 1/1978 |
| JP | 62288634 | A | 12/1987 |
| JP | 2013-520863 | | 1/1988 |
| JP | 63137193 | A | 6/1988 |
| JP | 01006187 | A | 1/1989 |
| JP | 07126867 | A | 5/1995 |
| JP | 07229076 | A | 8/1995 |
| JP | 2000-512690 | A | 9/2000 |
| JP | 2000282288 | A | 10/2000 |
| JP | 2002013081 | A | 1/2002 |
| JP | 2004-307980 | A | 11/2004 |
| JP | 4164511 | B2 | 10/2008 |
| JP | 2010-100934 | A | 5/2010 |
| RU | 2005108883 | A | 10/2006 |
| SU | 703150 | A2 | 12/1979 |
| WO | 90 00634 | | 1/1990 |
| WO | 97/48832 | A2 | 12/1997 |
| WO | 2004097855 | A1 | 11/2004 |

OTHER PUBLICATIONS

Kelvar Technical Guide (DuPont); available at http://www2.dupont.com/Kevlar/en_US/assets/downloads/Technical%20Guide%20for%KEVLAR_2011.pdf.

ASTM Standard B 254. "Standard Practice for Preparation and Electroplating on Stainless Steel." ASTM International (1998).

Complete Textile Glossary, Celanese Acetate LLC, 2001, definition of yarn.

William Blum, "The Structure and Properties of Alternately Electrodeposited Metals", paper presented at the Fortieth General Meeting of the American Electromechanical Society, Oct. 1, 1921 at Lake Placid, NY.

T.R. Briggs, "Electrolytic Solution and Deposition o Copper", paper presented at the Fortieth General meeting of the American Electromechanical Society, Oct. 1, 1921 at Lake Placid, NY.

S.K. Ghosh, et al., "Tribiological behaviour and residual stress of electodeposited Ni/Cu multilayer films on stainless steel substrate", ScienceDirect Surface & Coatings Technology 201 (2007) pp. 4609-4618.

R. V. Sara: Fabrication and Properties of Graphite-Fiber, Nickel-Matrix Composites, 14th National Symposium, Nov. 1968, Union Carbide Corp., Carbon Products Division.

Office Action dated Apr. 1, 2015 pertaining to Chinese Patent Application No. 201180045946.4.

Office Action dated Apr. 20, 2015 pertaining to Japanese Patent Application No. 2013-520863.

Office Action dated Jun. 30, 2015 pertaining to U.S. Appl. No. 13/187,927.

* cited by examiner

METAL AND METALLIZED FIBER HYBRID WIRE

CROSS REFERENCE TO RELATED APPLICATIONS

This application claims priority under 35 U.S.C. §119(e) to U.S. Provisional Patent Application Ser. No. 61/428,175, filed on Dec. 29, 2010.

BACKGROUND

Due to the rapidly growing number of available electronic devices, controls, and communication devices, many industries, including but not limited to the automotive, aerospace, and electronic textile industries, have seen a corresponding growth in demand for ways to effectively integrate such electronic devices, controls, and communication devices, as well as their corresponding power systems, into systems and products. The increased number of electronic devices, controls, communication devices, and power systems have required an increase in the number of wires and cables that must be incorporated into such systems and products for applications (for example, power transfer and signal transmission applications). The conventional electrical wires used have been typically made of highly conductive metals such as copper, silver, and alloys thereof. However, the weight of metal wires is undesirable for applications where weight savings are important. Examples of such applications include, but are not limited to, automobiles, aircraft, spacecraft, watercraft, and electronic textile applications.

Some known efforts to reduce the weight of electrical wiring systems have involved replacing standard gauge copper wire (eg., 22 gauge) with a smaller gauge wire (e.g., 26 or 28 gauge). Although the much thinner and lighter wire (e.g., gauge 26 or 28 copper wire) exhibits ample electrical conductivity, it falls short on mechanical performance (e.g., necessary mechanical strength and durability), particularly for power transfer and signal transmission in vehicles. Mechanical strength and fatigue resistance can be increased by using metal alloys (for example, CS-95 beryllium copper alloy), but such alloys show decreased conductivity (for example, 63% as compared to pure copper wire). Additionally, flexibility is a desirable property in wires, particularly in applications such as, for example, in vehicles where space is a premium and thus flexibility in the wires is a desirable property. Moreover, in applications such as, for example, wearable textiles, flexibility and durability are also desirable. It has been discovered that due to the rigidity and fatigue characteristic of metal wires, particularly reduced gauge wires, such wires do not provide the desired strength durability and flexibility for certain applications.

SUMMARY

The present disclosure advances the art by providing improved wires and wiring systems that utilize light weight, mechanically robust metallized fibers containing a desired volume fraction of metal but having a metallic conductivity comparable to current state-of-the-art high strength metal alloys.

In various embodiments, provided are conductive metal and metallized fiber hybrid wires (hereinafter, "Hybrid Wire") having a central member and a peripheral member, the peripheral member comprising (i) at least one conductive metal filament; and (ii) optionally, one or more conductive metallized fibers (monofilament or multi-filament fibers having at least one coating of metal thereon). Examples of fibers that may be suitable for metallization and use with the provided Hybrid Wire include, but are not limited to, Vectran® fiber (Kuraray), Ekonol® fiber (Saint-Gobain), Xydar® fiber (Solvay), Zylon® (PBO) fiber, Kevlar® (aramid) fiber, PEEK (polyether ether ketone) fiber, Ultem® (polyetherimide) fiber, PPS (polyphenylene sulfide) fiber, poly(p-phenylenebenzobisthiazole) (PBZT) fiber, poly(p-phenylenebenzobisimidazole (PBI) fiber, M5® (Magellan Systems), wholly aromatic liquid crystalline fiber, and carbon fiber (including nanotube, graphene or its derivatives). The central member of the provided wire may comprise (i) at least one non-metallized fiber; (ii) at least one of the provided conductive metallized fibers; (iii) at least one conductive metal filament; or (iv) combinations thereof.

In various embodiments, the metallized fibers of the Hybrid Wire may be independently selected from metallized polymer fibers. In some embodiments, the provided Hybrid Wire comprises at least one metallized wholly aromatic liquid crystalline polymer fiber that is a polyester consisting essentially of repeating units of (I) and (II):

(I) is 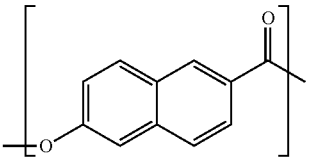 ;

(II) is 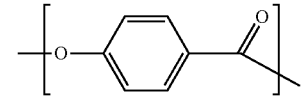 ;

wherein at least one hydrogen of an aromatic ring of (I), (II), or both, may optionally be substituted with an alkyl group, an alkoxy group, a halogen, or combinations thereof. Examples of suitable wholly aromatic liquid crystalline polymer fibers are Vectran® fibers (Kuraray), Ekonol® fibers (Saint-Gobain), and Xydar® fibers (Solvay).

These and additional objects of the present disclosure will become apparent in the course of the following detailed description.

BRIEF DESCRIPTION OF THE DRAWINGS

A more complete appreciation of the invention and the many embodiments thereof will be readily obtained as the same becomes better understood by reference to the following detailed description when considered in connection with the accompanying drawings, wherein.

DETAILED DESCRIPTION

Figure 1:
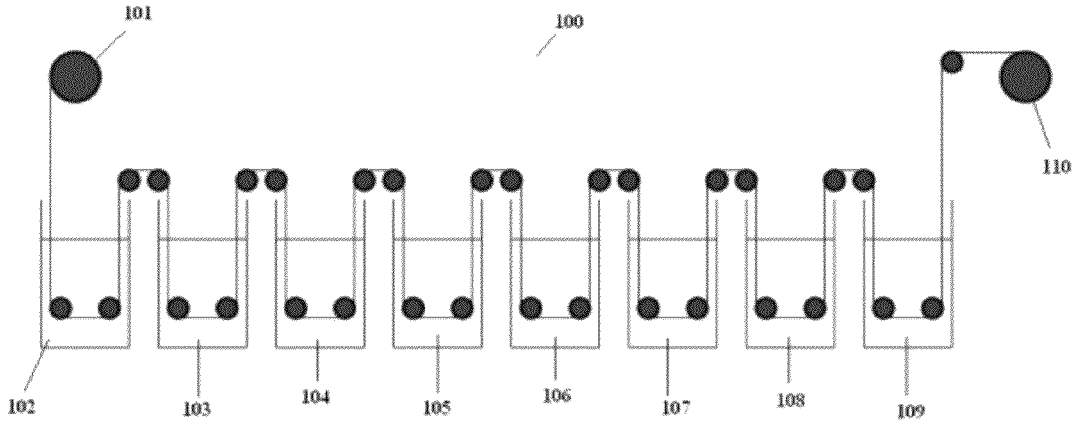
FIG. 1 depicts a schematic of one illustrative process for producing metal-coated fibers suitable for use in the provided Hybrid Wires, wherein in some embodiments, the fiber may be continuously transferred from bath to bath utilizing one or more rollers, wherein tension control is achieved by adjusting fiber transfer speed between each bath.

The present disclosure will include occasional reference to the specific embodiments of the invention. The invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of ingredients, properties such as molecular weight, reaction conditions, and so forth as used in the specification and claims are to be understood as being modified in all instances by the term "about." Additionally, the disclosure of any ranges in the specification and claims are to be understood as including the range itself and also anything subsumed therein, as well as endpoints. Unless otherwise indicated, the numerical properties set forth in the specification and claims are approximations that may vary depending on the desired properties sought to be obtained in embodiments of the present invention. Notwithstanding that numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

As set forth above, the present disclosure advances the art by providing improved wires and wiring systems. The provided Hybrid Wire surprisingly comprises well-balanced material properties, including but not limited to low weight, low electrical resistance, high tensile strength, fatigue resistance, good mechanical flexibility, thermal and thermo-oxidative stability, and/or solderability. Accordingly, Hybrid Wires are suitable for use in diverse applications, such as aerospace, automotive, and wearable textile industries. For example, such wires may be suitable for signal transmission, power transfer, satellite antennas, space tether, communications, space glove and suit, heating elements, and electronic textiles (for example, heated socks, heated pads, and heated fabrics).

In various embodiments, the provided Hybrid Wires have a central member and a peripheral member, the peripheral member comprising (i) at least one conductive metal filament; and (ii) optionally, at least one conductive metallized fiber. In some embodiments, the peripheral member substantially surrounds the central member. In some embodiments, the peripheral member is twisted around the central member. In some embodiments, the peripheral member is compressed around the central member. The central member of the provided wire may comprise (i) at least one conductive metal filament; (ii) at least one non-metallized fiber; (iii) at least one conductive metallized fiber; or (iv) combinations thereof. The conductive metallized fibers of the peripheral member may be the same or different from the conductive metallized fibers of the central member. Moreover, the peripheral member may comprise more than one type of conductive metallized fiber, and the central member may comprise more than one type of conductive metallized fiber. Similarly, the conductive metal filament of the peripheral member may be the same or different from the conductive metal filament of the central member.

Central Member

An illustrative Hybrid Wire may comprise a central member and a peripheral member, wherein the central member is coaxially-aligned with the central axis of the peripheral member. The central member may comprise (i) at least one conductive metal filament; (ii) at least one non-metallized fiber; (iii) at least one conductive metallized fiber; or (iv) combinations thereof.

In some embodiments, the central member comprises at least one conductive metal filament, which may be any metal wire conductor in any configuration. Accordingly, the central member may comprise one, two, three, four, or more conductive metal filaments. Illustrative metals that may be used for such filaments include, but are not limited to, copper, silver, aluminum, nickel, gold, other conductive metals, as well as composites, alloys, and combinations thereof. Suitable metal filaments include (but are not limited to) commercially available conductive metal wires, such as copper and copper alloy (for example, CS-95 beryllium copper alloy) wires. In some embodiments, the at least one conductive metal filament may be a solid metal wire. In some embodiments, the at least one conductive metal filament may be a stranded metal wire. In certain embodiments, the central member may comprise at least one conductive metal filament and at least one non-metallized fiber (as described below herein). In certain embodiments, the central member may comprise at least one conductive metal filament and at least one conductive metallized fiber (as described below herein).

In some embodiments, the central member may comprise at least one non-metallized fiber (monofilament or multifilament). Accordingly, the central member may comprise 1-10, 10-20, 20-30, 30-40, 40-50, 50-60, 60-70, 70-80, 80-90, 90-100, or more non-metallized fibers. Similarly, the central member may comprise 100-200, 200-300, 300-400, 400-500, 500-600, 600-700, 700-800, 800-900, 900-1000 non-metallized fibers. For example, a fiber selected from Vectran® fiber (Kuraray), Ekonol® fiber (Saint-Gobain), Xydar® fiber (Solvay), Zylon® (PBO) fiber, Kevlar® (aramid) fiber, PEEK (polyether ether ketone) fiber, Ultem® (polyetherimide) fiber, and PPS (polyphenylene sulfide) fiber may be suitable, provided that such selected fiber has not been modified to be conductive. As another example, the non-metallized fiber may be high tensile strength fibers or ribbons made of conductive carbon nanotubes, graphene or its derivatives (collectively, "carbon fiber"). The central member may comprise one, two, three, four, or more non-metallized fibers (monofilament or multi-filament). In certain embodiments, the central member may comprise at least one non-metallized fiber and at least one conductive metal filament. In certain embodiments, the central member may comprise at least one non-metallized fiber and at least one conductive metallized polymer fiber (as described below herein).

In some embodiments, the central member may comprise at least one conductive metallized fiber (monofilament or multifilament). Accordingly, the central member may comprise 1-10, 10-20, 20-30, 30-40, 40-50, 50-60, 60-70, 70-80, 80-90, 90-100, or more metallized fibers. Similarly, the central member may comprise 100-200, 200-300, 300-400, 400-500, 500-600, 600-700, 700-800, 800-900, 900-1000 metallized fibers. In certain embodiments, the central member may comprise at least one conductive metallized fiber and at least one conductive metal filament. In certain embodiments, the central member may comprise at least one conductive metallized fiber and at least one non-metallized fiber. In certain embodiments, the central member may comprise at least one conductive metallized high-temperature aromatic polymer fiber comprising (a) at least one coating of electroless-plated metal on the fiber and (b) optionally, at least one coating of electroplated metal on the electroless-plated metal. However, other types of metal coated fibers may also be suitable. For example, fibers having at least one layer of metal coated by physical vapor deposition, thermal spray, chemical vapor deposition (CVD), or sputter deposition techniques may also be suitable for use in the provided Hybrid Wire.

Deposited electroless-plated metals may, in some embodiments, be selected from nickel, copper, silver, and alloys thereof (for example, nickel/phosphorous and nickel/boron). In some embodiments, the provided fibers comprise at least one coating of electroless-plated nickel/phosphorous alloy. Deposited electroplated metals may, in some embodiments, be selected from tin, nickel, copper, silver, gold, and alloys thereof. Whether deposited by electroless plating or electroplating methods, metals may be deposited in one, two, three, four, or more layers, each layer being of a metal that is the same as or different from the previous layer. In some embodiments, the deposited metal layers may have a cumulative thickness of from about 1 μm to about 10 μm. Accordingly, the cumulative thickness of the deposited metal layers may be 1 μm, 2 μm, 3 μm, 4 μm, 5 μM, 6 μm, 7 μm, 8 μm, 9 μm, 10 μm, any thickness therebetween, or combinations thereof. In some embodiments, the fibers coated by the metal(s) are liquid crystalline polymer fibers. In some embodiments, the fibers are melt processable, thermotropic wholly aromatic liquid crystalline polymer fibers. Examples include, but are not limited to, Vectran® fiber (Kuraray), Ekonol® fiber (Saint-Gobain), and Xydar® fiber (Solvay). However, it is contemplated that other types of high temperature fibers, such as Zylon® (PBO) fiber and Kevlar® (PPTA) fiber, PEEK (polyether ether ketone) fiber, Ultem® (polyetherimide) fiber, and PPS (polyphenylene sulfide) fiber may also be used to produce suitable metallized fibers for use in the provided Hybrid Wire. Other examples of contemplated fibers include rigid rod fibers such as poly(p-phenylenebenzobisthiazole) (PBZT) fiber, poly(p-phenylenebenzobisimidazole) (PBI) fiber, and M5® (Magellan Systems) fiber; rod-like (also called rigid-chain) fibers such as poly(p-phenyleneterephthalamide) (PPTA) fiber; and carbon fibers (nanotube, graphene or its derivatives).

In various embodiments, wholly aromatic polyester liquid crystalline fibers may be used to form suitable metallized polymer fibers for use in the provided Hybrid Wire. Wholly aromatic polyester liquid crystalline polymers are known in the art, and many are commercially available. Examples include, but are not limited to, those comprising moieties derived from one or more of 6-hydroxy-2-naphthoic acid; 4,4'-biphenol; hydroquinone; p-hydroxybenzoic acid; terephthalic acid; isophthalic acid; and ring-substituted derivatives thereof. In some embodiments, suitable wholly aromatic liquid crystalline polymer fibers are melt processable, thermotropic polyesters of 2,6-dicarboxynaphthalene and p-oxybenzoyl moieties, or ring-substituted derivatives thereof. Accordingly, fibers to be metal plated and used in the provided Hybrid Wire may, in some embodiments, consist essentially of repeating units of (I) and (II):

(I) is 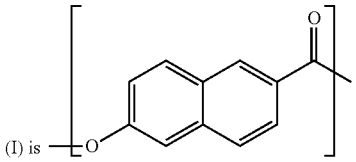 ;

(II) is 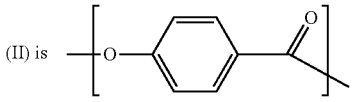 ;

wherein at least one hydrogen of an aromatic ring of (I), (II), or both, may optionally be substituted with an alkyl group, an alkoxy group, a halogen, or combinations thereof.

For purposes of illustration, embodiments wherein Vectran® fiber is used in the Hybrid Wire will be described. However, the scope of the present disclosure is not intended to be limited by such illustration. Rather, the scope is intended to encompass other fibers, including but not limited to, other high temperature aromatic polymers and other wholly aromatic polyester liquid crystalline fibers.

Vectran® fiber is a highly oriented multi-filament polyester-polyarylate liquid crystalline polymer fiber exhibiting a very high tensile strength and high melting temperature. Vectran® fiber is three to five times stronger than other polyesters and is stronger than aramid fibers (Kevlar®). In addition to having high strength, Vectran® fiber has excellent rigidity, tenacity retention, abrasion resistance, moisture resistance, and property retention over a broad range of temperatures and chemical environments. Some properties of Vectran® fiber, as compared to other high strength materials, are illustrated in Table 1.

TABLE 1

| Fiber | Tensile Strength (GPa) | Tensile Modulus (GPa) | Density (g/cm$^3$) | Specific Strength/Breaking Length (km) |
|---|---|---|---|---|
| Vectran ® NT | 1.1 | 52 | 1.4 | 79 |
| Vectran ® HT | 3.2 | 75 | 1.41 | 229 |
| Vectran ® UM | 3.0 | 103 | 1.4 | 215 |
| Titanium | 1.3 | 110 | 4.5 | 29 |
| Stainless Steel | 2.0 | 210 | 7.9 | 26 |
| Aluminum | 0.6 | 70 | 2.8 | 22 |
| E-Glass | 3.4 | 72 | 2.6 | 130 |
| Graphite | 4.3 | 230 | 1.8 | 240 |

Source: "*Vectran, Grasp the World of Tomorrow*," Kuraray America, Inc., 2006.

Vectran® fiber is different from other high strength fibers, such as aramid fiber, poly(p-phenylene-2,6-benzobisoxazole) (PBO) fiber, and ultra-high molecular weight polyethylene (HMPE) fiber. Aramid fiber (Kevlar®, DuPont) and PBO fiber (Zylon®, Toyobo) are solvent-spun fibers, and HMPE fiber (Spectra®, Honeywell) is gel-spun. In contrast to such fibers, Vectran® fiber is a thermotropic liquid crystalline polymer formed by melt-spinning through fine diameter capillaries, a process causing molecular chains to orient parallel to the fiber axis without chain folding. By comparison, the molecular chains of conventional polyesters are random and flexible and have chain folding. Vectran® fiber is hydrophobic, resistant to hydrolytic degradation, and shows good tenacity retention in aggressive chemical exposure. Because the residue moisture absorbed by a fiber during metallization processes may remain with the fiber after metallization, hydrolytic stability of fibers is important for long-term stability, especially when the metallized fiber will be used at elevated temperatures. Vectran® fiber has higher hydrolytic stability than other fibers, including Kevlar® and Zylon® fibers. Additionally, it has been reported that the tenacity retention of Vectran® fiber is far superior to standard Aramid fiber, like Kevlar®, after 300 hours thermal exposure at 250° C.

The highly conductive metallized polymer fibers described herein have advantages over metal wires (including copper wires) in terms of flexibility, light weight, strength, durability, and tailored electrical/mechanical properties. For example, Vectran® fibers have a high tensile strength and Young's modulus, low density, and small diameter and thus have distinct advantages over copper wires with respect to mechanical flexibility and weight savings. Thus, it has been discovered that polymer fibers such as Vectran® fiber are attractive for metallization. While wholly aromatic polyester liquid crystalline polymer fibers such as Vectran® fiber may be attractive substrates for metallization, there are challenges to metallizing such fibers. Vectran® fiber is unique with respect to its formation and its properties, and such uniqueness presents challenges to its use in applications. The fiber is hydrophobic, exhibits high bundle stiffness, is sensitive to static, has thermoplastic properties, and it has a multi-layered fiber structure, all of which create unique challenges to processes of metallization. Thus, known processes for metallization of polymer fibers are not suitable for metallization of fibers such as Vectran® fibers. However, metallized Vectran® fiber (or other wholly aromatic polyester liquid crystalline fibers) may be prepared by the process described below. Such metallized polymers may have higher long-term hydrolytic stability, higher temperature capability, higher conductivity, or combinations thereof, with respect to metallized Kevlar® fiber, metallized Zylon® fiber, and other metallized fibers.

In light of the aforementioned, in some embodiments the metallized fibers of the provided Hybrid Wire are prepared by a process comprising (a) etching the surface of a melt processable, thermotropic wholly aromatic liquid crystalline polymer fiber by contacting it with alkaline solution in the presence of ultrasonic agitation, wherein the alkaline solution does not comprise surfactant or solubilizer; (b) contacting the fiber of (a) with one or more electroless plating catalysts selected from salts of silver, nickel, gold, platinum, osmium, palladium, and rhodium; (c) contacting the fiber of (b) with a reducing solution; (d) electrolessly plating at least one coating of metal on the fiber of (c), the electroless-plated metal selected from nickel, copper, silver, and alloys thereof; and (e) optionally, electroplating at least one coating of metal on the fiber of (d), the electroplated metal selected from tin, nickel, copper, silver, gold, and alloys thereof. While the process is described with respect to melt processable, thermotropic wholly aromatic liquid crystalline polymer fibers (including, but not limited to Vectran® fibers), other fibers contemplated to be suitable for use in the disclosed process include, but are not limited to, PEEK (polyether ether ketone) fiber; Ultem® (polyetherimide) fiber; and PPS (polyphenylene sulfide) fiber.

In some embodiments, a metallized polymer fiber suitable for use in the provided Hybrid Wire comprises one or more coatings of electrolessly-plated metal, each coating being of the same or different metal as the prior coating. In some embodiments, the resulting metallized fiber further comprises one or more coatings of electroplated metal, each coating being of the same or different metal as the prior coating. The electrical conductivity of the resulting metallized fiber can be tuned over a very wide range depending on the plating thickness and composition of the metal coating. As one example, resistance of a metallized fiber may range from about 0.1 Ohm per foot to about 300 Ohm per foot. Accordingly, resistance can be from 0.1-0.5, 0.5-1, 1-5, 5-10, 10-20, 20-30, 30-40, 40-50, 50-60, 60-70, 70-80, 80-90, 90-100, 100-110, 110-120, 120-130, 130-140, 140-150, 150-160, 160-170, 170-180, 180-190, 190-200, 200-210, 210-220, 220-230, 230-240, 240-250, 250-260, 260-270, 270-280, 280-290, 290-300 Ohms per foot, any resistance therebetween, and combinations thereof.

In the disclosed process below, one or more highly conductive metals are deposited onto polymer fibers by an autocatalytic deposition process, commonly referred to as "electroless plating." The autocatalytic deposition process allows for uniform deposition of metal onto catalyzed surfaces of objects that are immersed in a solution. The electroless plating process occurs without application of an electrical current. Instead, deposition occurs through a controlled electrochemical reduction process. Various conductive metals can be deposited. In some embodiments, one or more of copper, nickel, silver, gold, and alloys thereof, may be deposited. In some embodiments, one or more uniform layers of metal may be deposited (via electroplating techniques) onto the electrolessly-plated metal coating(s).

(a) Surface Modification

The purpose of surface modification is to provide some interlocking mechanism on the polymer fiber for chemical and/or physical bonding with the subsequently applied electroless metal plating. Vectran® fiber is a thermotropic liquid crystalline polymer (LCP) fiber which provides excellent resistance to a wide range of organic and inorganic chemicals. Conventional processes (such as those described in U.S. Pat. Nos. 5,302,415; 5,422,142; 5,453,299; 5,935,706; and 6,045,680) to uniformly metallize multiple-filament polymeric fibers of polyaramid, polyamide, or polyester involve strong acid surface preconditioning (often in combination with surfactant to help the acid to penetrate fiber bundles) followed by electroless nickel coating. However, such processes do not work on Vectran® fiber, which is damaged by highly concentrated acids, and the treated fiber cannot be wetted effectively to accept subsequent seeding of the catalyst and initiation of the electroless plating step. For example, attempts to use highly concentrated sulfuric acid (90-98 wt %) to modify fiber surface were not successful. Furthermore, it was observed that the conventional process of using potassium permanganate in concentrated sulfuric acid is also ineffective in roughening and wetting the surface of Vectran® fibers in a manner suitable for continuous production.

U.S. Pat. Nos. 6,403,211 and 6,923,919 disclose a process of how to effectively etch a liquid crystalline polymer film with a heated potassium hydroxide (KOH) bath with ethanolamine solubilizer. In addition, they describe that a liquid crystalline polymer (LCP) film is preconditioned insufficiently by KOH solution alone. It was unexpectedly observed, however, that the methods described with respect LCP films are not applicable to LCP fibers. In contrast to the described processes for etching a LCP film, the provided process allows for successful modification of Vectran® fiber surfaces with a heated alkaline solution alone (i.e., without any solubilizer or surfactant). It was observed that, at least with respect to Vectran® fibers, ultrasonic agitation was unexpectedly required to be used to facilitate proper etching. This suggests that ultrasonic agitation operates in the provided process in a manner other than its conventional purpose, which is to merely clean a fiber surface. Without being bound by theory, it is contemplated that because Vectran® fiber is highly stretched during its manufacturing processing, significant changes in fiber surface structure morphology, molecular weight, crystallinity, and melting point are introduced, and that such changes give rise to significant differences, especially on the material surface, between the properties of a LCP film and those of a LCP fiber. Due to such differences, what is known about treating LCP films is not applicable to treating LCP fibers.

The disclosed process comprises contacting the fiber with alkaline solution. The alkaline solution may be one or more of a strong base, including but not limited to, bases such as lithium hydroxide (LiOH), sodium hydroxide (NaOH), potassium hydroxide (KOH), rubidium hydroxide (RbOH), cesium hydroxide (CsOH), calcium hydroxide (Ca(OH)2), strontium hydroxide (Sr(OH)2), barium chloride (Ba(OH)2). Good results have been achieved with KOH. However, it was observed that excess alkaline solution etching of Vectran® fibers not only significantly damages the strength of the fiber but also removes the delicate etched surface morphology that helps to promote the metal-to-polymer adhesive property. Thus, in order not to significantly alter the core mechanical integrity of the fiber and its etched surface structure, one or more of the chemical solvent, the solution concentration, and the solution processing temperature may be selected to provide the desired characteristics.

Good results have been obtained by etching Vectran® fibers in an aqueous solution of KOH at a temperature of from about 40° C. to 100° C. Thus, temperature may be from about 40° C.-45° C., 45° C.-50° C., 50° C.-55° C., 55° C.-60° C., 60° C.-65° C., 65° C.-70° C., 70° C.-75° C., 75° C.-80° C., 80° C.-85° C., 85° C.-90° C., 90° C.-95° C., 95° C.-100° C., any temperature therebetween, and combinations thereof. In some embodiments, the temperature may be from about 45° C. to 65° C.; alternatively, from about 55° C. to 65° C.; alternatively, from about 50° C. to 80° C.; alternatively, from about 80° C. to 100° C. In some embodiments, the KOH solution has a concentration of from about 20 wt % to about 65 wt %, wherein the concentration is selected to avoid extensive fiber damage. Thus, concentration may be from 20-25 wt %, 25-30 wt %, 30-35 wt %, 35-40 wt %, 40-45 wt %, 45-50 wt %, 50-55 wt %, 55-60 wt %, 60-65 wt %, any concentration therebetween, and combinations thereof. In some embodiments, the concentration may be from about 30 wt % to about 45 wt %. In some embodiments, the concentration may be from about 45 wt % to about 60 wt %. It has been observed that if the KOH solution concentration and temperature drop below 30 wt % and 50° C., respectively, the Vectran® fiber surface is not sufficiently wetted to effectively accept the subsequently applied catalyst in a timely manner. However, it has also been observed that fiber strength starts to decrease when KOH solution concentration and temperature are above 30 wt % and 50° C., respectively. Moreover, due to the small diameter of Vectran®monofilaments, surface modification as little as one micron deep will result in 16% loss of the whole fiber strength. Therefore, it is important that etching conditions be selected such that the KOH solution can etch each filament effectively and uniformly in as short a period of time as possible. In some embodiments, KOH etching should occur simultaneously with ultrasonic agitation. Vectran® fiber is available in 5, 20, 40, 80 and higher monofilament tows, and the provided processes may be used on the same to provide metallized Vectran® fibers having a variable number of monofilaments. Good results have been obtained by etching a 40 monofilament tow of Vectran® fiber, while simultaneously providing ultrasonic agitation at 25-120 KHz, for a period of from about 10 seconds to about 200 seconds. In some embodiments, agitation may be from about 25-45 KHz; alternatively, from about 45-65 KHz; alternatively, from about 65-85 KHz; alternatively, from about 85-105 KHz; alternatively, from about 105-120 KHz. In some embodiments, the period of time may be from about 50 to 100 seconds; alternatively, from about 100 to 200 seconds; alternatively, from about 10 to 50 seconds.

In some embodiments, a favorable KOH solution etching environment may be achieved with the combination of mechanical agitation arising due to continuous movement of yarn monofilaments during operation of the continuous process with additional agitation created by ultrasound. Without being bound by theory, it is believed that the enormous surface disruption upon cavitation under ultrasonic agitation and the repeated mechanical rubbing among the continuously moving filaments result in a surface adapted for accepting catalyst. This is evidenced by observations that approximately 100% of a treated Vectran® surface may be metallized by the combination of the KOH etching and ultrasound agitation, whereas only 80 to 90% surface metallization occurred when no ultrasonic agitation was used.

In some embodiments, one or more optional rollers may be used to aid in the surface modification of the Vectran® fiber. In some embodiments, the rollers may be selected from cylindrical and non-cylindrical rollers. For example, a non-cylindrical roller may have a transverse cross-section having a triangular, hexagonal, octagonal, or other suitable shape adapted to, when in operation, provide alternating levels of tension on yarn. As another example, one or more rollers such as those described in US2008/0280045 A1 may be used in some embodiments, which is hereby incorporated by reference herein. The one or more rollers may be used to continuously transfer the Vectran® fiber from one chemical bath to another chemical bath, from a chemical bath to a rinse bath, from a rinse bath to chemical bath, and combinations thereof, which provides mechanical agitation to open up the fiber tow for better solution penetration.

(b) Catalyzing

The catalysis process comprises seeding a catalyst onto the polymer fiber surface to initiate the electroless plating process. For purposes of illustration, palladium (Pd) catalyst will be discussed. However, one of skill in the art will recognize that other catalysts may alternatively be used. For example, it is contemplated that suitable catalysts may be selected from salts of silver, nickel, gold, platinum, osmium, palladium, and rhodium. Under a conventional electroless plating process, the fiber substrate is immersed in a mixed acidic colloidal solution of stannous chloride ($SnCl_2$) sensitizer and palladium chloride ($PdCl_2$) catalyst. In the colloidal solution, the Sn(II) will be oxidized to Sn(IV) while the Pd(II) will be reduced back to Pd, and the Pd nucleus will be readily absorbed onto the fiber surface as the working catalyst. Despite the mixed colloidal solution's increasing popularity with most persons of skill in the art, the initial nucleation sites generated by a separate Sn—Pd process may be as much as an order of magnitude more numerous than those produced by the mixed Sn—Pd approach. Generally, the higher the number of nucleation sites, the better the metal-to-substrate adhesive properties. Thus, in the provided process, the etched fiber is immersed in a dilute catalyst solution for a sufficient period of time to allow the catalyst to migrate and penetrate into the etched fiber structure. In some embodiments, the catalyst solution is a palladium chloride ($PdCl_2$)/hydrochloric acid (HCl) solution and the Pd ions migrate and penetrate into the etched fiber structure. In some embodiments, a suitable period for immersion may be from about 1-360 seconds. Accordingly, immersion may be from about 1-30 seconds, 30-60 seconds, 60-90 seconds, 90-120 seconds, 120-150 seconds, 150-180 seconds, 180-210 seconds, 210-240 seconds, 240-270 seconds, 270-300 seconds, 300-330 seconds, 330-360 seconds, any period therebetween, and combinations thereof. In some embodiments, immersion may be from 2-3 minutes, 3-4 minutes, 4-5 minutes, and combinations thereof. In some embodiments, the acid/catalyst solution may comprise from about 0.01 to 0.5 g/L of catalyst. Thus, the catalyst concentration may be from about 0.01-0.05 g/L, 0.05-0.10 g/L, 0.10-0.15 g/L, 0.15-0.20 g/L, 0.20-0.25 g/L, 0.25-0.30 g/L, 0.30-0.35 g/L, 0.35-0.40 g/L, 0.40-0.45 g/L, 0.45-0.50 g/L, any concentration therebetween, and combinations thereof. Good results have been obtained with a catalyst concentration of from about 0.1 to 0.3 g/L. One of skill will appreciate, however, that acceptable results may also be obtained with other catalysis and reduction approaches. For example, it is contemplated that a mixed colloidal solution approach may be used.

In some embodiments, the acid/catalyst solution may also comprise one or more surfactants (e.g., sodium lauryl sulfate or ammonia lauryl sulfate) to facilitate catalyst absorption onto the fiber surface. One of skill in the art will recognize that catalysts other than Pd may be utilized and that concentrations of catalyst in the acid/catalyst solution and period of immersion may be varied to accommodate different properties and characteristics of the specific catalyst chosen.

(c) Reducing

After the fiber is immersed in the acid/catalyst solution for a suitable period of time to allow the catalyst ion to migrate and penetrate the fiber bundle, such catalysts ions (e.g., Pd ions) are then reduced in situ by immersion for a suitable period of time in a separate reducing solution, such as a sodium borohydride solution or dimethylamine borane solution. In some embodiments, the reducing solution comprises from about 0.01 wt % to about 0.10 wt % of reducing agent. Thus, the reducing agent concentration may be from about 0.01-0.05 wt %, 0.05-0.10 wt %, any concentration therebetween, and combinations thereof. Good results have been obtained using a reducing agent concentration of from about 0.02 to 0.03 wt %. In some embodiments, immersion may be less than 60 seconds. For example, immersion may be from about 15-60 seconds. Good results have been obtained when immersion is less than 30 seconds. One of skill in the art will recognize that reducing agents other than sodium borohydride and dimethylamine borane may be utilized and that concentrations of reducing agent in the reducing solution and period of immersion may be varied to accommodate different properties and characteristics of the specific reducing agent chosen.

(d) Electroless Plating

Electroless plating is an autocatalytic deposition process that places metal onto objects that are immersed in a plating solution, wherein a uniform metallic coating is deposited conformably onto catalytic surfaces under a controlled electrochemical reduction process without applying an electrical current. Electroless plating is, in a general manner, well known. However, challenges nevertheless remain, such as obtaining good adhesion of the plated metal to the fiber surface.

The provided process achieves good adhesion of metal, in part, through the choice of plating alloy. For example, a nickel sulfate based-electroless nickel solution (8 to 10 wt % Phosphorus content) may be used for nickel metallization. Such a plating solution is capable of depositing a 20 micron nickel coating onto a catalyzed Vectran® fiber at 88° C. in one hour. The suitability of nickel-phosphorus alloy coatings was surprising given the prior art teachings regarding electroless plating of fibers. For example, U.S. Pat. Nos. 5,935,706 and 6,045,680 teach against use of nickel-phosphorus alloys to coat fibers.

In practice of the provided process, nickel-phosphorus alloys may be deposited. However, it is also contemplated that metals and metal alloys other than nickel-phosphorous may also be deposited by electroless plating. Examples include nickel-boron, copper, silver and alloys thereof. In some embodiments, more than one layer of metal may be deposited by electroless plating.

In some embodiments, electroless plating techniques are used to provide a uniform metal coating over the fiber surface. For example, a uniform metal coating may be greater than 85% of the fiber surface area. Accordingly, the coating may be 85%, 86%, 87%, 88%, 89%, 90%, 91%, 92%, 93%, 94%, 95%, 96%, 97%, 98%, 99%, 100%, any percentage therebetween, or combinations thereof, of the fiber surface area. In the provided process, the deposited metal coats the fiber. It does not, however, form a matrix in which the fiber is embedded or encased within metal and functions to reinforce the metal matrix.

(e) Optional Electroplating

As the fibers become electrically conductive after electroless plating (e.g., after deposition of a nickel coating), one or more additional coatings of conductive metal, such as tin, nickel, copper, silver or gold, may optionally be deposited via traditional electroplating techniques. Accordingly, in some embodiments, the provided process comprises preparing metallized polymer fibers with electroplated metal. In some embodiments, the provided process comprises preparing metallized polymer fibers without electroplated metal. In some embodiments, a fiber having a uniform coating of electroplated metals may be achieved by, among other things, controlling voltage during the electroplating process. After the step of optional electroplating, the resulting metallized fiber may be further processes by known methods.

For purposes of illustrating the disclosed process, reference to the schematic of FIG. 1 is made. Depicted therein is a continuous process 100, wherein melt-processable, thermotropic wholly aromatic liquid crystalline polymer fiber 101 is sequentially transported through an etching station 102 in which the fiber is contacted with alkaline solution and ultrasonic agitation (not labeled); through a water rinse station 103; through a catalyst seeding station 104 in which the fiber is contacted with one or more electroless plating catalysts; through a reducing station 105 in which the fiber is contacted with a reducing solution; through a water rinse station 106; through an electroless plating station 107 wherein one or more coatings of electroless metal are deposited onto the fiber; through a water rinse station 108; through an electroplating station 109 wherein one or more coatings of electroplated metal are deposited onto the one or more coatings of electroless metal, the sum of which produces a provided metallized fiber 110. In the continuous process 100, one or more optional special rollers (not labeled), tension control (for example, below 50 g), and combinations may be employed in at least the etching step. Tension control may also be achieved by adjusting fiber transfer speed between each bath.

While the aforementioned metallization process has been useful in plating wholly aromatic polyester liquid crystalline fibers such as Vectran® fiber, other processes of coating polymer fibers with metal (for example, vacuum metallization, thermal spray, chemical vapor deposition, and sputter deposition techniques) are also considered to be within the scope of the present disclosure, and the resulting metallized polymer fibers are also considered to be suitable for use with the provided Hybrid Wire. For example, metal plated Zylon® (PBO) fiber or Kevlar® (aramid) fiber prepared by chemical vapor deposition or vacuum metallization techniques may also be suitable for use in the provided Hybrid Wire.

Peripheral Member

A provided Hybrid Wire may comprise a central member and a peripheral member. In some embodiments, the peripheral member may substantially encompass or surround the central member. A peripheral member may comprise (i) at least one conductive metal filament; and (ii) optionally, at least one conductive metallized fibers.

A suitable conductive metal filament for use in the peripheral member may be any metal wire conductor in any configuration. Accordingly, the peripheral member may comprise one, two, three, four, five, six, seven, eight, nine, ten, eleven, twelve, or more conductive metal filaments. Illustrative metals that may be used for metal filaments include, but are not limited to, copper, silver, aluminum, nickel, gold, other conductive metals, composites, alloys, and combinations thereof. Suitable metal filaments include (but are not limited to) commercially available conductive metal wires, such as copper and copper alloy (for example, CS-95 beryllium copper alloy) wires.

In some embodiments, the central member may optionally comprise one or more conductive metallized fibers. Suitable conductive metallized fibers are the same as those described herein for use as central members. Accordingly, in some embodiments, the peripheral member may comprise 1-10, 10-20, 20-30, 30-40, 40-50, 50-60, 60-70, 70-80, 80-90, 90-100, 100-200, 200-300, 300-400, 400-500, 500-600, 600-700, 700-800, 800-900, 900-1000 metallized fibers.

Hybrid Wire

A Hybrid Wire of the present disclosure comprises (a) a central member comprising (i) at least one non-metallized fiber; (ii) at least one conductive metallized fiber; (iii) at least one conductive metal filament; or (iv) combinations thereof, as described elsewhere herein; and (b) a peripheral member comprising (i) at least one conductive metal filament; and (ii) optionally, at least one conductive metallized fiber described elsewhere herein.

In some embodiments, the provided Hybrid Wire has a central member comprising at least one conductive metallized fiber and a peripheral member comprising at least one conductive metal filament and one or more conductive metallized fibers. In certain embodiments, the central member of such Hybrid Wire may be a plurality of conductive metallized polymer fibers.

In some embodiments, the provided Hybrid Wire has a central member comprising at least one conductive metal filament and a peripheral member comprising at least one conductive metal filament and one or more conductive metallized fibers. In certain embodiments, the central member of such Hybrid Wire may be a single or a plurality of conductive metal filaments. In certain embodiments, the central member of such Hybrid Wire may be at least one conductive metal filament and one or more conductive metallized fibers.

In some embodiments, the provided Hybrid Wire has a central member comprising at least one conductive metallized fiber and a peripheral member having at least one conductive metal filament but lacking conductive metallized fibers. In certain embodiments, the central member of such Hybrid Wire may be a plurality of conductive metallized fibers.

The provided Hybrid Wire disclosed and described herein may, in various embodiments, be a circularly compressed wire. Circular compression may provide additional advantages, including improved straightness, increased breaking force, improved impact resistance, and reduced end disjointing, as compared to an uncompressed Hybrid Wire.

Figure 2:
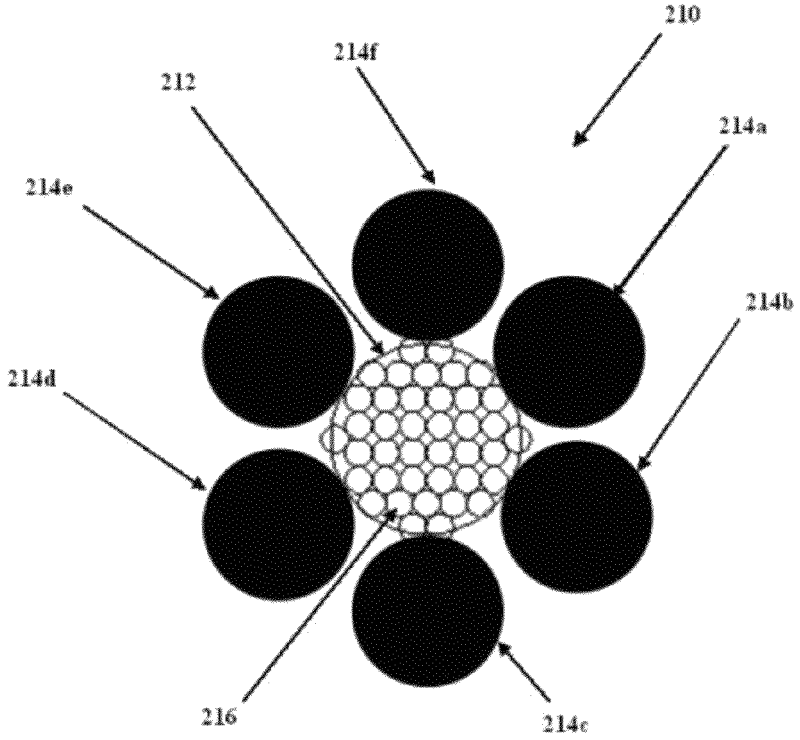
FIG. 2 is a schematic representation of one example of a provided Hybrid Wire.

Referring to FIG. 2, one example of a provided Hybrid Wire 210 is disclosed. Such Hybrid Wire 210 may comprise a central member 212 and a peripheral member 214 consisting of a plurality of metal filaments 214*a*, 214*b*, 214*c*, 214*d*, 214*e*, 214*f* substantially encompassing or surrounding the central member 212. In other words, central member 212 is coaxially-aligned with the central axis of the metal filaments 214*a-f*. The peripheral member 214 may have metal filaments 214*a-f* of any type of metal wire conductors (including multiple types within the same wire), and such metal filaments 214*a-f* may be in any configuration. Illustrative metals that may be used for metal filaments 214*a-f* include, but are not limited to, copper, silver, aluminum, nickel, gold, other conductive metals, as well as composites, alloys, and other combinations thereof. Metal filaments 214*a-f* may be independently selected from commercially available conductive wires. Central member 212 may comprise a plurality of metallized fibers 216. For example, such metallized fibers 216 may comprise uniform layer(s) of metal(s) deposited through one or more of electroless and/or electroplating methods. Illustrative metals that may be deposited onto the fibers 216 may include nickel, copper, silver, gold, or combinations thereof. Although shown with only metallized fibers 216, a central member 212 having at least one conductive metal filament (not shown), at least one non-metallized fiber (not shown), or both, is also within the scope of the provided disclosure.

Figure 3A:
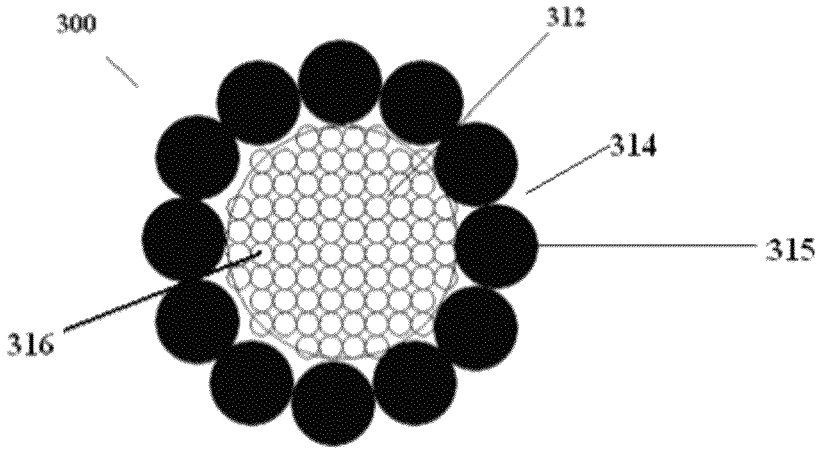
FIG. 3A is a schematic representation of one example of a provided Hybrid Wire.

Referring to FIG. 3, illustrated are additional examples of Hybrid Wires 300 in 26 gauge (AWG) configurations. The configuration illustrated in FIG. 3A comprises a peripheral member 314 having twelve 38 gauge (AWG) metal filaments 315 (for example, copper wires) substantially surrounding or encompassing a central member 312 that comprises a plurality of metallized polymer fibers 316. For example, central member 312 may comprise a Vectran® yarn that includes 80 monofilament or multifilament fibers (such as metallized Vectran 80F yarn). In this example, central member 312 (i.e., the whole metalized Vectran yarn) shows about 0.5 ohm/ft electrical resistance, about 0.164 lb/Mft weight, and about 0.282 mm diameter. By using 85% of the reported Vectran fiber strength and 33% of the copper strength, the estimated combined breaking tensile strength of Hybrid Wire 300 is about 20.6 lbs at a physical weight of about 0.751 lbs/Mft.

Figure 3B:
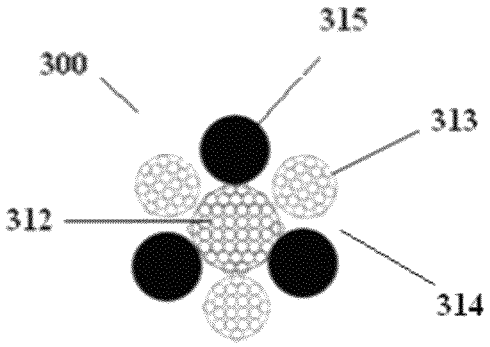
FIG. 3B is a schematic representation of another example of a provided Hybrid Wire.

The configuration illustrated in FIG. 3B comprises a peripheral member 314 having three 38 gauge (AWG) metal filaments 315 (for example, copper wires) surrounding or encompassing a central member 312 that comprises a metallized polymer yarn, wherein between each metal filament 315 of the peripheral member 314 is a metallized polymer wire 313 that is the same or different from that of the central member 312. Therefore, the peripheral member 314 comprises metal filaments 315 and metallized polymer fibers 313. The central member 312 comprises a metallized polymer yarn that includes 40 monofilament or multifilament fibers (such as metallized Vectran 40F yarn). Each metallized polymer fiber 313 of the peripheral member 314 comprises a metallized polymer yarn that includes 20 monofilament or multifilament fibers (such as metallized Vectran 20F yarn).

Figure 3C:
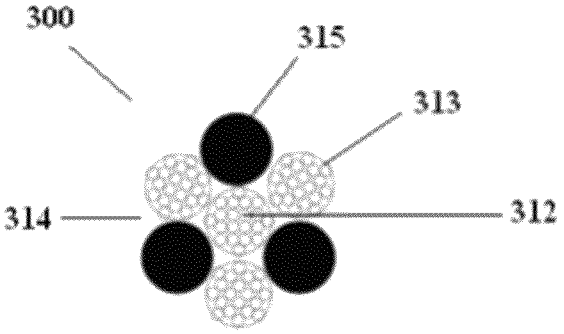
FIG. 3C is a schematic representation of still another example of a provided Hybrid Wire.

The configuration illustrated in FIG. 3C comprises a peripheral member 314 having three 38 gauge (AWG) metal filaments 315 (for example, copper wires) surrounding or encompassing a central member 312 that comprises a metallized polymer yarn, wherein between each metal filament 315 is a metallized polymer fiber 313. The central member 312 comprises a metallized polymer fiber that includes 20 monofilament or multifilament fibers (such as metallized Vectran 20F yarn). Each metallized polymer fiber 313 of the peripheral member 314 comprises a metallized polymer yarn that includes 20 monofilament or multifilament fibers (such as metallized Vectran 20F yarn).

Figure 4:
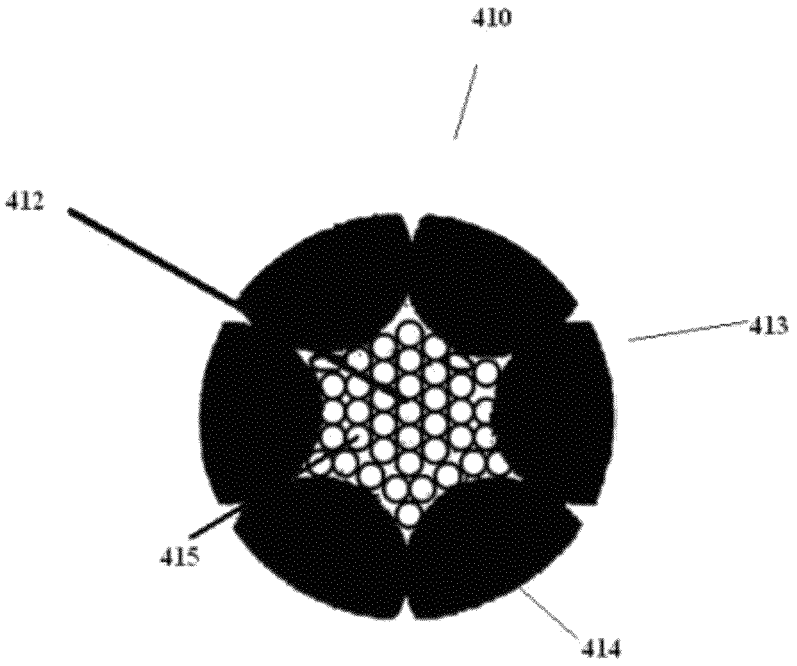
FIG. 4 is a schematic representation of one example of a provided Hybrid Wire, wherein such wire is a circularly compressed wire.
Figure 5:
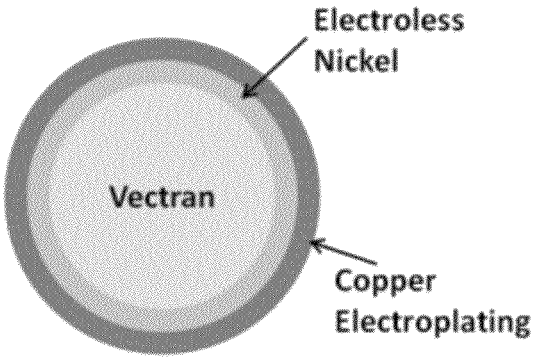
FIG. 5 depicts a schematic representation of a cross-section of one metal-coated polymer fiber monofilament prepared according to the disclosed process.
Figure 6:
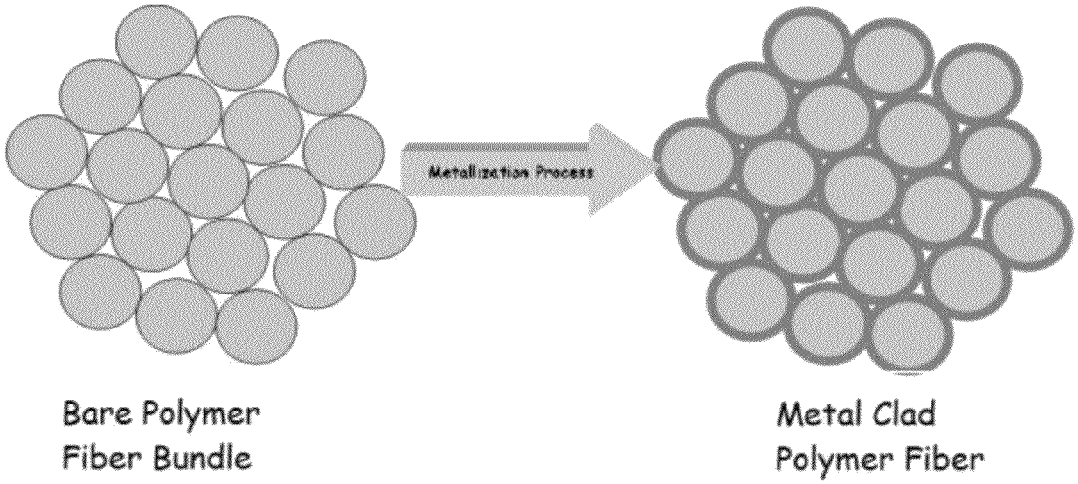
FIG. 6 depicts a schematic of metallization of a bundle of polymer fiber monofilaments by the disclosed process.

Referring to FIG. 4, illustrated is an example of a circularly compressed Hybrid Wire 410 comprising a central member 412 and a peripheral member 413 having a plurality of metal filaments 414 substantially encompassing or surrounding the central member 412. The peripheral member 413 may have metal filaments 414 of any type of metal wire conductors (including multiple types within the same wire), and such metal filaments 414 are compressed around the central member 412. As shown, central member 412 may comprise a plurality of metallized fibers 415. Although shown with only metallized fibers 415, a central member 412 having at least one conductive metal filament (not shown), at least one non-metallized fiber (not shown), or both, is also within the scope of the provided disclosure.

Although specific examples of Hybrid Wires are described in the figures and specification, it is to be understood that such examples are not limiting. In particular, the scope of the present disclosure is not limited to 26 gauge (AWG) Hybrid Wires. Table 2 describes gauge numbers and associated measurements associated with conventional wires. It is contemplated that the provided Hybrid Wires may be of any gauge, including from 20 to 40 gauge (AWG).

TABLE 2

| Gauge (AWG) | Diameter (inch) | Diameter (mm) | Cross-sectional area ($mm^2$) | Resistance (Ohm/m) |
|---|---|---|---|---|
| 20 | 0.032 | 0.812 | 0.518 | 0.0333 |
| 21 | 0.0285 | 0.723 | 0.41 | 0.042 |
| 22 | 0.0253 | 0.644 | 0.326 | 0.053 |
| 23 | 0.0226 | 0.573 | 0.258 | 0.0668 |
| 24 | 0.0201 | 0.511 | 0.205 | 0.0842 |
| 25 | 0.0179 | 0.455 | 0.162 | 0.106 |
| 26 | 0.0159 | 0.405 | 0.129 | 0.134 |

TABLE 2-continued

| Gauge (AWG) | Diameter (inch) | Diameter (mm) | Cross-sectional area ($mm^2$) | Resistance (Ohm/m) |
|---|---|---|---|---|
| 27 | 0.0142 | 0.361 | 0.102 | 0.169 |
| 28 | 0.0126 | 0.321 | 0.081 | 0.213 |
| 29 | 0.0113 | 0.286 | 0.0642 | 0.268 |
| 30 | 0.01 | 0.255 | 0.0509 | 0.339 |
| 31 | 0.00893 | 0.227 | 0.0404 | 0.427 |
| 32 | 0.00795 | 0.202 | 0.032 | 0.538 |
| 33 | 0.00708 | 0.18 | 0.0254 | 0.679 |
| 34 | 0.00631 | 0.16 | 0.0201 | 0.856 |
| 35 | 0.00562 | 0.143 | 0.016 | 1.08 |
| 36 | 0.005 | 0.127 | 0.0127 | 1.36 |
| 37 | 0.00445 | 0.113 | 0.01 | 1.72 |
| 38 | 0.00397 | 0.101 | 0.00797 | 2.16 |
| 39 | 0.00353 | 0.0897 | 0.00632 | 2.73 |
| 40 | 0.00314 | 0.0799 | 0.00501 | 3.44 |

EXAMPLES

The present invention will be better understood by reference to the following examples, which are offered by way of illustration not limitation.

Example 1

26 Gauge (AWG) Hybrid Wires (Vectran® Fiber), as Compared to Conventional Wires Table 3 below summarizes the properties (some of which are prophetic) of 26 gauge (AWG) Hybrid Wires (Samples C-G) having metallized polymer fiber (in central member and/or peripheral member) that is metallized Vectran® fiber, as compared to the same properties of conventional 26 gauge (AWG) copper 7/34 wire (Sample A) and conventional 26 gauge (AWG) copper 19/38 wire (Sample B). Specific configurations of metal/metallized polymer Hybrid Wire described in Table 3, the Figures, and the specification should not be considered as limiting, as additional configurations are also contemplated.

TABLE 3

| Sample | AWG 26 Conductor† | Copper wire gauge | Metallized Vectran ® fiber | Est. Weight/ MFT (lbs) | Est. Diameter (mm) | Est. Breaking Strength (lbs) | Est. Resistance (Ohm/MET) |
|---|---|---|---|---|---|---|---|
| A | Copper 7/34 | 7/34 | None | 0.865 | 0.48 | 7.83 | 39.5 |
| | 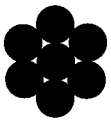 | | | | | | |
| B | Copper 19/38 | 19/38 | None | 0.928 | 0.50 | 8.6 | 36.6 |
| | 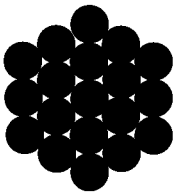 | | | | | | |

TABLE 3-continued

| Sample | AWG 26 Conductor† | Copper wire gauge | Metallized Vectran ® fiber | Est. Weight/ MFT (lbs) | Est. Diameter (mm) | Est. Breaking Strength (lbs) | Est. Resistance (Ohm/MET) |
|---|---|---|---|---|---|---|---|
| C | Copper 6/34 M. Vectran ® 40F | 6/34 | 40 filament | 0.824 | <0.52 | 11.7 | <47 |
| | 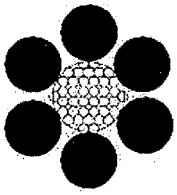 | | | | | | |
| D | Copper 8/36 M. Vectran ® 40F | 8/36 | 40 filament | 0.706 | <0.45 | 11.4 | <56 |
| | 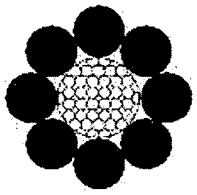 | | | | | | |
| E | Copper 12/38 M. Vectran ® 80F | 12/38 | 80 filament | 0.751 | <0.49 | 20.6 | <58 |
| | 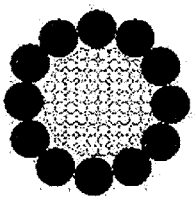 | | | | | | |
| F | Copper 8/36 M. Vectran® 80F | 8/36 | 80 filament | 0.788 | <0.54 | 20.7 | <56 |
| | 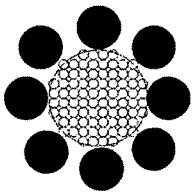 | | | | | | |

†Configurations are for conceptual illustration purposes only and are not to scale.

Comparing to breaking strength of 21 lbs and weight of 2.3 lbs/Mft of 22 gauge copper wire (Samples A and B), it is evident that the one or more embodiments of Hybrid Wires shown and described herein can deliver an acceptable AWG 26 electrical performance with an AWG 22 tensile strength at about 32% of the weight. Numerous alternations, modifications and variation of the embodiments herein will be apparent to those skilled in the art and they are all contemplated to be within the spirit and scope of the instant disclosure.

Example 2

26 Gauge (AWG) Hybrid Wires (Aramid)

In another example of the Hybrid Wire, one or more of the metallized Vectran® fibers of the central member disclosed above in Table 3 and Example 1 (samples C—F) may be substituted for at least one metallized aramid fiber (monofilament or multifilament). For example, one, two, three, four, or more Vectran® fibers may be replaced with metallized aramid fibers, or all Vectran fibers may be replaced with metallized aramid fibers. Metallized aramid fibers may be, but are not required to be, fabricated by method(s) shown and described in U.S. Pat. No. 5,218,171, which is hereby incorporated by reference herein.

The invention should not be considered limited to the specific examples and figures described herein, but rather should be understood to cover all aspects of the disclosure. Various modifications, equivalent processes, as well as numerous structures and devices to which the present invention may be applicable will be readily apparent to those of skill in the art. Those skilled in the art will understand that various changes may be made without departing from the scope of the invention, which is not to be considered limited to what is described in the specification.

The invention claimed is:

1. A conductive wire, comprising:

(a) a central member comprising a multifilament fiber bundle, the multifilament fiber bundle comprising a plurality of individual conductive metallized fibers and at least one non-metallized fiber;

(b) a peripheral member surrounding the central member, the peripheral member comprising a plurality of conductors, the plurality of conductors comprising at least one conductive metal filament and at least one conductive metallized fiber, wherein:

the conductive metallized fibers of the central member and the peripheral member comprise individual wholly aromatic liquid crystalline polymer fibers of a polyester each coated with a metal coating that covers greater than 90% of a fiber surface area of each individual wholly aromatic liquid crystalline polymer fiber, the polyester consisting essentially of repeating units of (I) and (II):

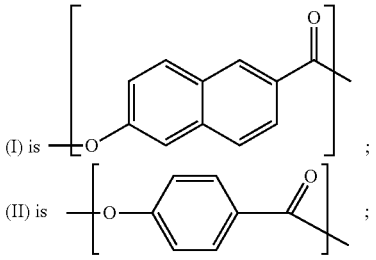

the at least one conductive metal filament of the peripheral member is a filament of a conductive material selected from copper, silver, aluminum, nickel, gold, or composites or alloys thereof.

2. The conductive wire of claim 1, wherein the metal coating on at least one individual conductive metallized fiber of the central member is electroless-plated nickel/phosphorus alloy.

3. The conductive wire of claim 2, wherein the metal coating on the at least one individual conductive metallized fiber of the central member further comprises at least one coating of electroplated metal on the electroless-plated nickel/phosphorus alloy, wherein the electroplated metal of each coating of electroplated metal is independently selected from tin, nickel, copper, silver, gold, and alloys thereof.

4. The conductive wire of claim 1, wherein the central member consists of the multifilament fiber bundle, and the peripheral member consists of a plurality of the conductive metal filaments and a plurality of the conductive metallized fibers.

5. A conductive wire, comprising:

(a) a central member comprising:

(i) at least one conductive metallized liquid crystalline polymer fiber coated with a metal coating that covers greater than 90% of a fiber surface area of the at least one conductive metallized liquid crystalline polymer fiber, the metal coating selected from nickel, nickel alloys, copper, copper alloys, silver, and silver alloys; and (ii) at least one non-metallized fiber; and (b) a peripheral member surrounding the central member, the peripheral member comprising at least one conductive metal filament of a conductive material selected from copper, silver, aluminum, nickel, gold, or composites or alloys thereof;

wherein at least one of the conductive metallized liquid crystalline polymer fibers is a melt-processable wholly aromatic polyester liquid crystalline polymer fiber consisting essentially of repeating units of (I) and (II):

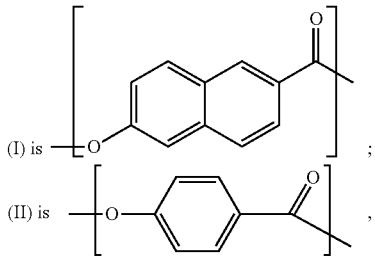

wherein at least one hydrogen of an aromatic ring of (I), (II), or both, is optionally substituted with an alkyl group, an alkoxy group, a halogen, or combinations thereof.

6. The conductive wire of claim 5, wherein the conductive metallized liquid crystalline polymer fiber comprises:

(a) at least one metal coating of electroless-plated metal selected from nickel, nickel alloys, copper, copper alloys, silver, and silver alloys (b) at least one coating of electroplated metal electroplated onto the at least one coating of electroless-plated metal, the electroplated metal of each coating of electroplated metal being selected from tin, nickel, copper, silver, gold, and alloys thereof.

7. The conductive wire of claim 6, wherein the at least one coating of electroless-plated metal is nickel/phosphorus alloy.

8. The conductive wire of claim 5, wherein the peripheral member further comprises at least one conductive metallized liquid crystalline polymer fiber.

9. The conductive wire of claim 6, wherein the conductive metallized liquid crystalline polymer fiber is prepared by a process comprising:

(a) etching a surface of a melt processable, thermotropic wholly aromatic liquid crystalline polymer fiber by contacting the surface with alkaline solution in the presence of ultrasonic agitation, wherein the alkaline solution does not comprise surfactant or solubilizer;

(b) contacting the fiber of (a) with one or more electroless plating catalysts selected from salts of silver, nickel, gold, platinum, osmium, palladium, and rhodium;

(c) contacting the fiber of (b) with a reducing solution;

(d) electrolessly plating at least one coating of metal on the fiber of (c), the electroless-plated metal selected from nickel, copper, silver, and alloys thereof; and (e) electroplating at least one coating of metal on the fiber of (d), the electroplated metal selected from tin, nickel, copper, silver, gold, and alloys thereof.

10. A conductive wire comprising:

(a) a central member comprising at least one conductive metallized fiber and at least one non-metallized fiber; and (b) a peripheral member comprising at least one conductive metal filament and at least one conductive metallized polymer fiber.

11. The conductive wire of claim 10, wherein the at least one non-metallized fiber comprises wholly aromatic polyester liquid crystalline fiber, poly(p-phenylene-2,6-benzobisoxazole) fiber, poly(p-phenyleneterephthalamide) fiber, polyether ether ketone fiber, polyphenylene sulfide fiber, poly (p-phenylenebenzobisthiazole), poly(pphenylenebenzobisimidazole) fiber, carbon fiber, or a combination thereof.

12. A conductive wire comprising:

(a) a central member comprising at least one conductive metallized liquid crystalline polymer fiber and at least one non-metallized fiber; and (b) a peripheral member comprising at least one conductive metal filament;

wherein at least one of the conductive metallized liquid crystalline polymer fibers is a melt-processable wholly aromatic polyester liquid crystalline polymer fiber consisting essentially of repeating units of (I) and (II):

(I) is 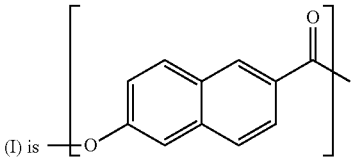

(II) is 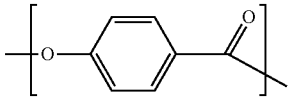

wherein at least one hydrogen of an aromatic ring of (I), (II), or both, is optionally substituted with an alkyl group, an alkoxy group, a halogen, or combinations thereof.

13. The conductive wire of claim 12, wherein the peripheral member further comprises at least one conductive metallized fiber.

14. A conductive wire, comprising:

a central member comprising a multifilament fiber bundle, the multifilament fiber bundle comprising:

a plurality of individual conductive metallized liquid crystalline polymer fibers each coated with at least one metal coating covering greater than 90% of a surface area of each individual conductive metallized fiber; and at least one non-metallized fiber; and a peripheral member comprising a plurality of conductors surrounding the central member, the plurality of conductors comprising a plurality of conductive metal filaments;

wherein:

the individual conductive metallized liquid crystalline polymer fibers are melt-processable wholly aromatic polyester liquid crystalline polymer fibers consisting essentially of repeating units of (I) and (II):

(I) is 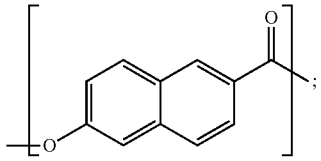

(II) is 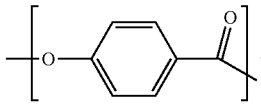

15. The conductive wire of claim 14, wherein:

the central member consists of the multifilament bundle; and the peripheral member consists of the plurality of conductive metal filaments.

16. The conductive wire of claim 14, wherein the plurality of conductors in the peripheral member further comprises at least one peripheral-member multifilament fiber bundle of individual conductive metallized liquid crystalline polymer fibers each coated with at least one metal coating selected from nickel, nickel alloys, copper, copper alloys, silver, and silver alloys.

17. The conductive wire of claim 16, wherein the individual conductive metallized liquid crystalline polymer fibers of the peripheral-member multifilament fiber bundle consist essentially of the repeating units of (I) and (II).

18. The conductive wire of claim 14, wherein:

the central member consists of the multifilament fiber bundle; and the peripheral member consists of the plurality of conductive metal filaments and the at least one peripheral-member multifilament fiber bundle.

19. A conductive wire, comprising:

(a) a central member comprising a multifilament fiber bundle, the multifilament fiber bundle comprising a plurality of individual conductive metallized fibers and at least one non-metallized fiber;

(b) a peripheral member surrounding the central member, the peripheral member comprising a plurality of conductors, the plurality of conductors comprising at least one conductive metal filament and at least one conductive metallized polymer fiber, wherein each individual conductive metallized polymer fiber of the central member is a polymer fiber coated with a metal coating that covers greater than 90% of a fiber surface area of the polymer fiber.

20. The conductive wire of claim 19, wherein the polymer fibers of the individual conductive metallized polymer fibers of the central member are chosen from wholly aromatic liquid crystalline polymer fiber, poly(p-phenylene-2,6-benzobisoxazole) fiber, poly(p-phenyleneterephthalamide) fiber, polyether ether ketone fiber, polyphenylene sulfide fiber, poly(p-phenylenebenzobisthiazole), and poly(p-phenylenebenzobisimidazole) fiber.

* * * * *